US011660613B2

(12) United States Patent
Nilsson et al.

(10) Patent No.: US 11,660,613 B2
(45) Date of Patent: May 30, 2023

(54) SEPARATION DISC FOR A CENTRIFUGAL SEPARATOR HAVING SPACING MEMBERS WITH A TRIANGULAR SHAPE

(71) Applicant: ALFA LAVAL CORPORATE AB, Lund (SE)

(72) Inventors: Sven-Åke Nilsson, Gnesta (SE); Peter Thorwid, Sundbyberg (SE)

(73) Assignee: ALFA LAVAL CORPORATE AB, Lund (SE)

( * ) Notice: Subject to any disclaimer, the term of this patent is extended or adjusted under 35 U.S.C. 154(b) by 93 days.

(21) Appl. No.: 17/316,448

(22) Filed: May 10, 2021

(65) Prior Publication Data

US 2021/0260605 A1 Aug. 26, 2021

Related U.S. Application Data

(63) Continuation of application No. 16/342,095, filed as application No. PCT/EP2017/077238 on Oct. 25, 2017, now Pat. No. 11,027,291.

(30) Foreign Application Priority Data

Oct. 31, 2016 (EP) ..... 16196560

(51) Int. Cl.
*B04B 7/14* (2006.01)
*B04B 1/08* (2006.01)

(52) U.S. Cl.
CPC . *B04B 7/14* (2013.01); *B04B 1/08* (2013.01)

(58) Field of Classification Search
CPC ..... B04B 1/08; B04B 7/14
(Continued)

(56) References Cited

U.S. PATENT DOCUMENTS 1,006,622 A * 10/1911 Bailey ..... B04B 7/12 494/75
1,602,752 A * 10/1926 Cuthbert ..... B04B 1/08 494/73

(Continued)

FOREIGN PATENT DOCUMENTS

AF 797778 A1 1/1981
AF 1261715 A1 10/1986

(Continued)

OTHER PUBLICATIONS

English translation of the Korean Office Action for Korean Application No. 10-2019-7015262, dated Jun. 19, 2020.

(Continued)

*Primary Examiner* — Charles Cooley
(74) *Attorney, Agent, or Firm* — Birch, Stewart, Kolasch & Birch, LLP

(57) ABSTRACT

A separation disc for a centrifugal separator is adapted to be included in a stack of separation discs inside a centrifugal rotor for separating a fluid mixture. The separation disc has a truncated conical shape with an inner surface and an outer surface and a plurality of spot-formed spacing members extending from at least one of the inner surface and the outer surface. The spot-formed spacing members are for providing interspaces between mutually adjacent separation discs in a stack of separation discs, and the plurality of spot-formed spacing members are tip-shaped and taper from a base at the surface of the separation disc towards a tip extending a height from the surface. A stack of separation discs, a centrifugal separator and a method for separating at least two components of a fluid mixture are also disclosed.

15 Claims, 5 Drawing Sheets

(58) Field of Classification Search
USPC ..... 494/70–73
See application file for complete search history.

(56) References Cited

U.S. PATENT DOCUMENTS

| | | | | |
|---|---|---|---|---|
| 2,028,955 | A * | 1/1936 | Shenstone | B04B 7/14 494/70 |
| 2,599,619 | A * | 6/1952 | Eckers | B04B 1/08 494/901 |
| 2,725,190 | A | 11/1955 | Hein et al. | |
| 3,335,946 | A * | 8/1967 | Putterlik | B04B 7/14 494/73 |
| 3,409,521 | A * | 11/1968 | Sharples | B04B 7/14 205/652 |
| 4,036,429 | A * | 7/1977 | Ivin | B04B 1/08 494/73 |
| 4,142,671 | A * | 3/1979 | Ivin | B04B 1/08 494/73 |
| 4,262,841 | A * | 4/1981 | Berber | B04B 7/14 494/73 |
| 4,622,029 | A | 11/1986 | Nilsson | |
| 4,861,329 | A | 8/1989 | Borgstrom | |
| 5,637,217 | A | 6/1997 | Herman et al. | |
| 5,720,705 | A | 2/1998 | Inge et al. | |
| 5,883,354 | A | 3/1999 | Elofson | |
| 6,526,794 | B1 | 3/2003 | Langer et al. | |
| 8,454,487 | B2 * | 6/2013 | Lindroth | B04B 1/08 494/70 |
| 8,562,503 | B2 * | 10/2013 | Rudman | B04B 7/14 494/73 |
| 8,678,989 | B2 * | 3/2014 | Rudman | B04B 7/14 494/73 |
| 9,550,192 | B2 | 1/2017 | Klintenstedt | |
| 9,687,858 | B2 | 6/2017 | Quiter et al. | |
| 9,914,138 | B2 | 3/2018 | Nilsson et al. | |
| 10,118,184 | B2 * | 11/2018 | Inge | B04B 5/12 |
| 10,888,880 | B2 * | 1/2021 | Törnblom | B04B 7/14 |
| 2001/0016549 | A1 | 8/2001 | Herman et al. | |
| 2003/0178014 | A1 | 9/2003 | Sauter et al. | |
| 2006/0100083 | A1 | 5/2006 | Lagerstedt et al. | |
| 2008/0015099 | A1 | 1/2008 | Heinrich | |
| 2010/0011723 | A1 | 1/2010 | Szepessy et al. | |
| 2011/0136649 | A1 | 6/2011 | Lindroth et al. | |
| 2011/0195832 | A1 | 8/2011 | Rudman et al. | |
| 2012/0174547 | A1 | 7/2012 | Törnblom et al. | |
| 2013/0067873 | A1 | 3/2013 | Szepessy et al. | |
| 2014/0148327 | A1 * | 5/2014 | Nilsson | B04B 1/08 72/208 |
| 2016/0001302 | A1 * | 1/2016 | Quiter | B04B 7/14 494/73 |
| 2016/0303579 | A1 | 10/2016 | Nilsson | |
| 2018/0147580 | A1 | 5/2018 | Nilsson et al. | |
| 2019/0247865 | A1 * | 8/2019 | Nilsson | B04B 1/08 |
| 2019/0247866 | A1 * | 8/2019 | Nilsson | B04B 1/08 |
| 2019/0262843 | A1 * | 8/2019 | Nilsson | A23C 13/12 |
| 2020/0376500 | A1 * | 12/2020 | Hagqvist | B04B 7/14 |
| 2021/0107014 | A1 * | 4/2021 | Hilding | B04B 1/08 |
| 2022/0258181 | A1 * | 8/2022 | Ölund | B04B 1/08 |

FOREIGN PATENT DOCUMENTS

| | | | |
|---|---|---|---|
| CN | 1042671 | A | 6/1990 |
| CN | 1179736 | A | 4/1998 |
| CN | 1615179 | A | 5/2005 |
| CN | 1832807 | A | 9/2006 |
| CN | 1942248 | A | 4/2007 |
| CN | 101619018 | A | 1/2010 |
| CN | 101862706 | A | 10/2010 |
| CN | 101884957 | A | 11/2010 |
| CN | 102083541 | A | 6/2011 |
| CN | 102099120 | A | 6/2011 |
| CN | 102227265 | A | 10/2011 |
| CN | 102227266 | A | 10/2011 |
| CN | 102821866 | A | 12/2012 |
| CN | 103357511 | A | 10/2013 |
| CN | 103357515 | A | 10/2013 |
| CN | 103702763 | A | 4/2014 |
| CN | 104284732 | A | 1/2015 |
| CN | 105188946 | A | 12/2015 |
| CN | 105813772 | A | 7/2016 |
| CN | 107771103 | A | 3/2018 |
| DE | 37 14399 | C1 | 4/1988 |
| DE | 195 37 268 | C1 | 2/1997 |
| DE | 69606973 | T2 | 6/2000 |
| EP | 0 806 985 | B1 | 7/2002 |
| GB | 466971 | A | 6/1937 |
| GB | 711695 | | 7/1954 |
| GB | 1 330 097 | | 9/1973 |
| JP | 2001-505476 | A | 4/2001 |
| JP | 2002-239414 | A | 8/2002 |
| JP | 2010-274210 | A | 12/2010 |
| KR | 10-92-006647 | B1 | 8/1992 |
| KR | 10-2014-0034299 | A | 3/2014 |
| RU | 17286 | * | 3/2001 |
| RU | 17286 | U1 | 3/2001 |
| SE | 23367 | | 7/1906 |
| SE | 528 844 | C2 | 2/2007 |
| SE | 532 153 | C2 | 11/2009 |
| WO | WO 90/05028 | A1 | 5/1990 |
| WO | WO 96/27445 | A1 | 9/1996 |
| WO | WO 2007/055630 | A1 | 5/2007 |
| WO | WO 2009/051545 | A1 | 4/2009 |
| WO | WO 2009/126104 | A1 | 10/2009 |
| WO | WO 2010/039097 | A1 | 4/2010 |
| WO | WO 2013/020978 | A1 | 2/2013 |
| WO | WO 2013/079194 | A2 | 6/2013 |
| WO | WO 2016/046944 | A1 | 3/2016 |
| WO | 2021/149239 | A1 * | 7/2021 |

OTHER PUBLICATIONS

English translation of the Russian Decision on Grant for Russian, dated Jun. 23, 2016 for Russian Application No. 2014108871/05.
European Office Action, dated, Nov. 3, 2016, for European Application No. 12743740.8.
International Search Report, issued in PCT/EP2012/065439, dated Jan. 24, 2013.
International Search Report, issued in PCT/EP2017/077238, dated Jan. 22, 2018.
International Search Report, issued in PCT/EP2017/077248, dated Jan. 17, 2018.
International Search Report, issued in PCT/EP2017/077284, dated Jan. 17, 2018.
U.S. Office Action, dated May 29, 2020, 2020, for U.S. Appl. No. 16/342,103.
U.S. Office Action, dated Oct. 7, 2020, for U.S. Appl. No. 15/882,695.
Written Opinion of the International Searching Authority, issued in PCT/EP2012/065439, dated Jan. 24, 2013.
Written Opinion of the International Searching Authority, issued in PCT/EP2017/077238, dated Jan. 22, 2018.
Written Opinion of the International Searching Authority, issued in PCT/EP2017/077248, dated Jan. 17, 2018.
Written Opinion of the International Searching Authority, issued in PCT/EP2017/077284, dated Jan. 17, 2018.

* cited by examiner

SEPARATION DISC FOR A CENTRIFUGAL SEPARATOR HAVING SPACING MEMBERS WITH A TRIANGULAR SHAPE

CROSS-REFERENCE TO RELATED APPLICATIONS

This application is a Continuation of U.S. application Ser. No. 16/342,095, filed on Apr. 15, 2019, which is the National Phase under 35 U.S.C. § 371 of International Application No. PCT/EP2017/077238, filed on Oct. 25, 2017, which claims priority under 35 U.S.C. § 119(a) to application Ser. No. 16/196,560.3, filed in Europe on Oct. 31, 2016, all of which are hereby expressly incorporated by reference into the present application

FIELD OF THE INVENTION

The present invention relates to the field of centrifugal separation, and more specifically to centrifugal separators comprising separation discs.

BACKGROUND OF THE INVENTION

Centrifugal separators are generally used for separation of liquids and/or solids from a liquid mixture or a gas mixture. During operation, fluid mixture that is about to be separated is introduced into a rotating bowl and due to the centrifugal forces, heavy particles or denser liquid, such as water, accumulates at the periphery of the rotating bowl whereas less dense liquid accumulates closer to the central axis of rotation. This allows for collection of the separated fractions, e.g. by means of different outlets arranged at the periphery and close to the rotational axis, respectively.

Separation discs are stacked in the rotating bowl at a mutual distance to form interspaces between themselves, thus forming surface-enlarging inserts within the bowl. Separation discs of metal are used in connection with relatively robust and large-sized centrifugal separators for separating liquid mixtures and the separation discs themselves are thus of relatively large size and are exposed to both high centrifugal and liquid forces. The liquid mixture to be separated in the centrifugal rotor is conducted through the interspaces, wherein the liquid mixture is separated into phases of different densities during operation of the centrifugal separator. The interspaces are provided by spacing members arranged on the surface of each separation disc. There are many ways of forming such spacing members. They may be formed by attaching separate members in the form of narrow strips or small circles of sheet metal to the separation disc, usually by spot welding them to the surface of the separation disc.

In order to maximize the separating capacity of the centrifugal separator, there is a desire to fit as many separation discs as possible into the stack within a given height in the separator. More separation discs in the stack means more interspaces in which the liquid mixture can be separated. However, as the separation discs are made thinner, they will exhibit a loss in rigidity and irregularities in their shape may begin to appear. The separation discs are furthermore compressed in the stack inside the centrifugal rotor to form a tight unit. Thin separation discs may thereby flex and/or because of their irregular shaping give rise to unevenly sized interspaces in the stack of separation discs. Accordingly, in certain parts of the interspaces (e.g. far away from a spacing member), the mutually adjacent separation discs may be completely compressed against each other to leave no interspaces at all. In other parts of the interspaces (e.g. in the vicinity of a spacing member) the separation discs will not flex much and accordingly provide an adequate height.

A disc comprising spot-shaped spacing members for decreasing the risk of unevenly sized interspaces in the stack is disclosed in WO2013020978. The disc in this disclosure comprises spot-shaped spacing members having spherical or cylindrical shape as seen in the direction of their height.

However, there is a need in the art for alternative designs for separation discs that facilitate the use of thin discs and therefore a large number of discs in a centrifugal separator.

SUMMARY OF THE INVENTION

A main object of the present invention is to provide a separation disc for a centrifugal separator that decreases the risk of unevenly sized interspaces in a stack.

A further object is to provide a disc that allows for the use of thin separation discs in a disc stack.

An object is also to provide a disc stack and a centrifugal separator comprising such separation discs.

As a first aspect of the invention, there is provided a separation disc for a centrifugal separator, the disc being adapted to be comprised in a stack of separation discs inside a centrifugal rotor for separating a fluid mixture, wherein the separation disc has a truncated conical shape with an inner surface and an outer surface and a plurality of spot-formed spacing members extending from at least one of the inner surface and the outer surface, wherein the spot-formed spacing members are for providing interspaces between mutually adjacent separation discs in a stack of separation discs, and wherein the plurality of spot-formed spacing members have a tip-shaped cross-section that tapers from a base at the surface of the separation disc towards a tip extending a height from the surface.

The separation disc may e.g. comprise a metal or be of metal material, such as stainless steel.

The separation disc may further comprise a plastic material or be of a plastic material.

The separation disc may further also be adapted to be compressed in a stack of separation discs inside a centrifugal rotor for separating a liquid mixture.

A truncated conical shape refers to a shape that is frustoconical, i.e. having the shape of a frustum of a cone, which is the shape of a cone with the narrow end, or tip, removed. The axis of the truncated conical shape thus defines the axial direction of the separation disc, which is the direction of the height of the corresponding conical shape or the direction of the axis passing through the apex of the corresponding conical shape.

The inner surface is thus the surface facing the axis whereas the outer surface is the surface facing away from the axis of the truncated cone. The spot-formed spacing-members may be provided only on the inner surface, only at the outer surface or on both the inner and outer surface of the truncated conical shape.

Half of the opening angle of the frustoconical shape is usually defined as the "alpha angle". As an example the separation disc may have an alpha angle between 25° and 45°, such as between 35° and 40°.

A spacing member is a member on the surface of a disc that spaces two separation discs apart when they are stacked on top of each other, i.e. defining the interspace between the discs. The spot-formed spacing members are tip-shaped at least in a cross-section of the spacing member and the cross-section, or the spacing member as a whole, thus tapers from the base at the surface towards a tip, which extends a certain height from the surface. The height of a tip-shaped spacing member is the height perpendicular to the surface.

The spot-formed spacing members may be tip-shaped in at least one cross-section, such as the cross-section perpendicular to the radius of the disc. Thus, the spot-formed spacing members may form small ridges that extend on the surface. The ridges may for example extend in a radial direction of the separation disc, i.e. substantially along a direction of flow of fluid mixture along the separation disc.

The spot-formed spacing members may be tip-shaped in more than one cross-section.

The spot-formed spacing members may be tip-shaped as a whole, i.e. each cross section of a spot-formed spacing member is tip-shaped. Thus, the spot-formed spacing members may e.g. have the form of a cone, i.e. be cone-shaped, or the form of a pyramid, depending on the form of the base along the surface. The base at the surface may thus have the form as a cross, a circle, an ellipse, a square or have a rectangular shape.

As an example, the tip-shaped spacing members may have the form of a cone or a pyramid, i.e. have a geometric shape that tapers smoothly from the flat base at the surface to the tip, i.e. to an apex a certain height above the base. The apex may be directly above the centroid of the base. However, the apex may also be located at a point that is not above the centroid so that the tip-shaped spacing members have the form of an oblique cone or an oblique pyramid.

The first aspect of the invention is based on the insight that if spot-formed and tip-shaped spacing members are introduced on the surfaces of the thin metal separation discs, then equidistant spaces in a stack comprising thin separation discs may be achieved. Hence, the separating capacity of the centrifugal separator can in this way be further increased by fitting a greater number of the thinner metal separation discs into the stack. The invention will in this way facilitate the use of separation discs as thin as possible to maximize the number of separation discs and interspaces within a given stack height. Furthermore, the tip-shaped and spot-formed spacing members lead to less contact area between a spacing member of a disc and an adjacent disc, thus leading to a larger surface area of the discs in a stack being available for separation. Further, a small contact area decreases the risk of dirt or impurities being stuck within a disc stack during operation of a centrifugal separator, i.e. decreases the risk of contamination. Also, the equidistant spaces in between the separation discs contribute to decreasing the risk of dirt or impurities being stuck within the disc stack during operation of the centrifugal separator. Moreover, the equidistant spaces provide for improved separation performance in the centrifugal separator. Since the interspaces formed between the separation discs are equidistant, the separation performance is substantially the same all over the separation area formed within the disc stack, and thus, closer to a theoretically calculated separation performance of the relevant centrifugal separator. Whereas in a prior art disc stack, wherein the separation discs are deformed during operation of the centrifugal separator and thus, form uneven interspaces between the discs, the separation performance varies within the disc stack, and therefore, is farther from the theoretically calculated separation performance of the relevant centrifugal separator.

In embodiments of the first aspect of the invention, the base of the spot-formed spacing members extend to a width which is less than 5 mm along the surface of the separation disc.

The width of the base of the spot-formed spacing member may refer to or correspond to the diameter of the spot-formed spacing member at the surface. If the base at the surface has an irregular shape, the width of the spot-formed spacing member may correspond to the largest extension of the base at the surface.

As an example, the base of the spot-formed spacing member may extend to a width which is less than 2 mm along the surface of the separation disc, such as to a width which is less than 1.5 mm along the surface of the separation disc, such as to a width which is about or less than 1 mm along the surface of the disc.

Thus, due to a small size compared to the "conventional" large-sized spacing members in the form of e.g. elongated strips, the spacing members may be provided in greater number without blocking or significantly impeding the flow of fluid mixture between the discs in a stack of separation discs.

In embodiments of the first aspect of the invention, the spot-formed spacing members extend from the surface of the separation disc in a direction that forms an angle with the surface which is less than 90 degrees.

Thus, the spot-formed spacing member does not have to extend perpendicular from the surface. The direction in which the spot-formed spacing members extend may be defined as the direction of the tip from the base, i.e. the direction of the axis passing through the tip to the center of the base. Thus, the spot-formed spacing members may extend from the surface of the separation disc in a direction that forms an angle with the surface which is less than 90 degrees, thus forming a direction of the tip from the surface that may be more aligned with the direction of the cone axis of the truncated conical shape. This is advantageous in that if the tip forms an angle with the surface which is less than 90 degrees, it may better adhere to the surface of an adjacent disc in a stack of discs and the tip may better withstand the large axial compression forces encountered in a compressed disc stack, i.e. there may be a decreased risk of the tip deforming when compressing the stack of separation discs. The direction in which the tip extends may thus be a direction against the outer periphery of the disc, if the tip is arranged on the inner surface of the disc, and the direction in which the tip extends may be a direction against the inner periphery of the disc, if the tip is arranged on the outer surface of the disc.

Further, the spot-formed spacing members may extend from the surface of the separation disc in substantially the axial direction of the truncated conical shape of the separation disc.

Since the discs are aligned axially, a tip extending axially will better adhere to an adjacent disc in the stack, thereby further decreasing the risk for unevenly sized interspaces between the discs as the stack is compressed. Further, tips extending axially may better withstand the axial compression forces encountered in a compressed disc stack.

However, the spot-formed spacing members may alternatively, or also extend from the surface of the separation disc in a direction that is substantially perpendicular to the surface of the separation disc.

In embodiments of the first aspect of the invention, the spot-formed spacing members extend to a height that is less than 0.8 mm from the surface of the separation disc.

As an example, the spot-formed spacing members may extend to a height that is less than 0.60, such as less than 0.50 mm, such as less than 0.40 mm, such as less than 0.30 mm, such as less than 0.25 mm, such as less than 0.20 mm, from the surface of the separation disc.

According to some embodiments, the spot-formed spacing members may extend to a height within a range of 0.3-0.1 mm, or 0.25-0.15 mm from the surface of the separation disc.

Since the separation disc has the form of a truncated cone, the height of the spot-formed spacing member over the truncated surface may be different than the actual axial interspace between discs in a stack of separation discs.

In embodiments of the first aspect of the invention, the tip of the spot-formed spacing members has a tip radius seen in a cross-section of the spot-formed spacing member which is less than the height to which the spot-formed spacing members extend from the surface.

As an example, the tip of the spot-formed spacing members may have a tip radius which is less than half the height, such as less than a quarter of the height, such as less than a tenth of the height, to which the spot-formed spacing members extend from the surface. With such a "sharp" tip, the spot-formed spacing member may more easily adhere to the surface of an adjacent disc in a disc stack, and a sharp tip also decreases blockage or obstruction of the flow of fluid mixture between the discs in a stack of separation discs.

In embodiments of the first aspect of the invention, a majority of the spot-formed spacing members are distributed on the surface of the separation disc at a mutual distance which is less than 20 mm.

As an example, the spot-formed spacing members may be distributed on the surface of the separation disc at a mutual distance which is less than 15 mm, such as about or less than 10 mm.

The spot-formed-spacing members may be evenly distributed on the surface, distributed in clusters, or distributed on the surface at different mutual distance, e.g. to form areas of the disc in which the density of spot-formed spacing members is higher compared to the density of spot-formed spacing members on the rest of the same surface of the disc.

In embodiments of the first aspect of the invention, the inner or outer surface of the separation disc has a surface density of the spot-formed and tip-shaped spacing members that is above 10 spacing members/$dm^2$, such as above 25 spacing members/$dm^2$, such as above 50 spacing members/$dm^2$, such as above 75 spacing members/$dm^2$, such as about or above 100 spacing members/$dm^2$.

Further, in embodiments of the first aspect of the invention, the inner or outer surface of the separation disc has a surface density of the spot-formed and tip-shaped spacing members that is above 10 spacing members/$dm^2$, such as above 25 spacing members/$dm^2$, such as above 50 spacing members/$dm^2$, such as above 75 spacing members/$dm^2$, such as about or above 100 spacing members/$dm^2$, and the separation disc having a thickness that is less than 0.40 mm, such as less than 0.30 mm.

However, the whole inner or outer surface does not have to be covered with the spot-formed and tip-shaped spacing members. Consequently, in embodiments of the first aspect of the invention, the inner or outer surface of the separation disc comprises at least one area of at least 1.0 $dm^2$ having a density of the spot-formed and tip-shaped spacing members that is above 10 spacing members/$dm^2$, such as above 25 spacing members/$dm^2$, such as above 50 spacing members/$dm^2$, such as above 75 spacing members/$dm^2$, such as about or above 100 spacing members/$dm^2$.

In embodiments of the first aspect of the invention, the spot-formed spacing members are distributed on the surface so that the surface density of spot-formed spacing members is higher at the outer periphery of the separation disc than on the rest of the disc. This may decrease the risk of unevenly sized interspaces forming between the discs as the stack is compressed. This is so because the compression may be greater at the outer periphery of a disc, and/or stress within a disc may manifest itself at the outer periphery of the disc. A higher density of the spot-formed spacing members may thus aid in keeping the appropriate interspace distance at the periphery of the disc. In more detail, when separation discs are compressed in a stack, the abutment between the discs at the spot-formed spacing members together with the disc material in between the spot-formed spacing members securely position the separation discs in relation to each other, with equidistant interspaces between the separation discs over the area covered by the respective separation discs. However, at the outer periphery of the separation discs, the disc material between the spot-formed spacing members of each separation disc forms a free end, and thus, is not secured in the same manner as farther in on the disc. Such a free end may require the higher density of the spot-formed spacing members in order to provide equidistant interspaces between the separation discs also at the peripheries of the discs.

For example, the spot-formed spacing members may be distributed with twice the density at the outer periphery of the disc as compared to the density of spot-formed spacing members on the rest of the disc. The outer periphery of the disc may be the disc surface area forming the outer 10-20 mm of the disc. In larger diameter separation discs, the outer periphery of the disc may be the disc surface area forming the outer 20-100 mm of the disc.

According to some embodiments the density of the spot-formed spacing members on the surface of a separation disc may increase from a radially inner portion of the separation disc to a radially outer portion of the separation disc. The increase may be gradual, from a low density of spot-formed spacing members at the radially inner portion of the separation disc to a high density of spot-formed spacing members at the radially outer portion of the separation disc. Alternatively, the increase may be provided in discrete steps, such that a low density of spot-formed spacing members is provided over an area at the radially inner portion of the separation disc, radially outside of the inner portion a higher density of spot-formed spacing members provided over an area, and so on to a highest density of spot-formed spacing members is provided over an area at the radially outer portion of the separation disc. For instance, the density may be increased in 2, 3, 2-4, or 3-6 discrete steps from the radially inner portion to the radially outer portion of the separation disc, e.g. depending on the diameter of the separation disc.

In embodiments of the first aspect of the invention, the spot-formed spacing members are provided on the inner surface of the separation disc.

For example, a majority of the spot-formed spacing members may be provided on the inner surface of the separation disc. Further, the spot-formed spacing members may be provided solely on the inner surface of the separation disc, meaning that the outer surface may be free of spot-formed spacing members, and optionally, the inner and/or outer surface may also be free of spacing members other than the spot-formed spacing members.

Furthermore, the spot-formed spacing members may be provided on the outer surface of the separation disc.

For example, a majority of the spot-formed spacing members may be provided on the outer surface of the separation disc. Further, the spot-formed spacing members may be provided solely on the outer surface of the separation disc, meaning that the inner surface may be free of spot-formed spacing members, and optionally, the inner and/or outer surface may also be free of spacing members other than the spot-formed spacing members.

Consequently, in embodiments, the spot-formed spacing members are provided solely on either the inner or the outer surface of the separation disc.

Furthermore, in embodiments of the first aspect of the invention, at least one of the inner surface and the outer surface are free of spacing members other than the spot-formed spacing members.

As an example, both the inner and the outer surface, i.e. the whole disc, may be free of spacing members other than the spot-formed spacing members.

This means that in a compressed stack of such separation discs, all interspaces between the discs in the stack are defined by the spot-formed spacing members.

However, the separation disc may also comprise spacing members other than the spot-formed spacing members, such as spacing members in the form of radial strips. These may be in the form of separate pieces of narrow strips or circular blanks of sheet metal, which are attached to the surface of the separation disc. Such radial strips, or elongated and radially extending spacing members, may have a length that is above 20 mm, such as above 50 mm, and e.g. a width that is above 4 mm.

In embodiments of the first aspect of the invention, the separation disc comprises less than 5 elongated and radially extending spacing members, such as less than 4, such as less than 3, such as less than 2, such as no radially extending spacing members.

Further, in embodiments of the first aspect of the invention, the separation disc comprises less than 5 spacing members other than the spot-formed spacing members, such as less than 4, such as less than 3, such as less than 2 such as no other spacing members than the spot-formed spacing members.

Thus, in embodiments of the first aspect of the invention, the spot-formed spacing members are provided on the separation disc so that they form the major load-bearing elements in a stack of such separation discs.

This means that a majority of the compression forces may be held by spot-formed spacing members in a stack of such separation discs In embodiments of the first aspect of the invention, the spot-formed spacing members are provided on a separation disc in an amount so that more than half of the total area of a disc surface occupied by spacing members is defined by the spot-formed spacing members. Consequently, in embodiments of the first aspect of the invention, the spot-formed spacing members form a majority of all spacing members on the separation disc.

As an example, more than 75%, such as all, total area of a disc surface occupied by spacing members may be defined by the spot-formed spacing members.

This means that in a compressed stack of such separation discs, a majority or all compressive forces are supported by the spot-formed spacing members.

In embodiments of the first aspect of the invention, the spot-formed spacing members are integrally formed in one piece with the material of the separation disc.

Thus, the spot-formed spacing members may be formed in the material of the separation disc in accordance with known techniques for manufacturing separation discs with integrally formed spacing members, such as the method disclosed in U.S. Pat. No. 6,526,794. The spacing members may be integrally formed in a metal disc by means of so called flow-forming, or they may alternatively be provided by means of any suitable press method—such as the method disclosed in WO2010039097 A1.

A plastic separation disc comprising spot-formed spacing members that are integrally formed in one piece with the material may be provided by means of e.g. injection molding.

In embodiments of the first aspect of the invention, the spot-formed spacing members are integrally formed in one piece with the material of the separation disc so that the surface of the separation disc back or behind of a spot-formed spacing member is flat or smooth, or at least forms a dent that is less than the height of a spacing member. Thus, if a spot-formed spacing member is formed on the inner surface of the separation disc, the outer surface of the separation disc behind the spot-formed spacing member may be more or less flat.

The thickness of the separation disc may be less than 0.8 mm, such as less than 0.6 mm. However, it may be advantageous to use thin separation discs in order to be able to stack as many discs as possible within a given height and thereby increase the overall separation area. Thus, in embodiments of the first aspect of the invention, the separation disc has a thickness that is less than 0.50 mm.

For example, the disc may have a thickness that is less than 0.40 mm, such as less than 0.35 mm, such as less than 0.30 mm.

In embodiments of the first aspect of the invention, the separation disc has a diameter that is more than 200 mm, such as more than 300 mm, such as more than 350 mm, such as more than 400 mm, such as more than 450 mm, such as more than 500 mm, such as more than 530 mm.

For example, the separation disc may have a diameter that is more than 300 mm and a thickness that is less than 0.40 mm, such as less than 0.30 mm.

As a further example, the separation disc may have a diameter that is more than 350 mm and a thickness that is less than 0.40 mm, such as less than 0.30 mm.

As a further example, the separation disc may have a diameter that is more than 400 mm and a thickness that is less than 0.40 mm, such as less than 0.30 mm.

As a further example, the separation disc may have a diameter that is more than 450 mm and a thickness that is less than 0.40 mm, such as less than 0.30 mm.

As a further example, the separation disc may have a diameter that is more than 500 mm and a thickness that is less than 0.40 mm, such as less than 0.30 mm.

As a further example, the separation disc may have a diameter that is more than 530 mm and a thickness that is less than 0.40 mm, such as less than 0.30 mm.

In embodiments of the first aspect of the invention, the separation disc comprises more than 300 spot-formed spacing members, such as more than 400 spot-formed spacing members, such as more than 500 spot-formed spacing members, such as more than 1000 spot-formed spacing members, such as more than 2000 spot-formed spacing members, such as more than 3000 spot-formed spacing members, such as more than 4000 spot-formed spacing members, and may have a thickness that is less than 0.40 mm, such as less than 0.30 mm.

For example, the separation disc may have a diameter that is more than 200 mm and comprise more than 200 spot-formed spacing members, such as more than 400 spot-formed spacing members, such as more than 600 spot-formed spacing members.

For example, the separation disc may have a diameter that is more than 300 mm and comprise more than 300 spot-formed spacing members, such as more than 600 spot-formed spacing members, such as more than 1000 spot-formed spacing members, such as more than 1300 spot-formed spacing members.

For example, the separation disc may have a diameter that is more than 350 mm and comprise more than 450 spot-formed spacing members, such as more than 900 spot-formed spacing members, such as more than 1400 spot-formed spacing members, such as more than 1800 spot-formed spacing members.

As a further example, the separation disc may have a diameter that is more than 400 mm and comprise more than 600 spot-formed spacing members, such as more than 1100 spot-formed spacing members, such as more than 1700 spot-formed spacing members, such as more than 2200 spot-formed spacing members.

As a further example, the separation disc may have a diameter that is more than 450 mm and comprise more than 700 spot-formed spacing members, such as more than 1400 spot-formed spacing members, such as more than 1900 spot-formed spacing members, such as more than 2800 spot-formed spacing members.

As a further example, the separation disc may have a diameter that is more than 500 mm and comprise more than 900 spot-formed spacing members, such as more than 1800 spot-formed spacing members, such as more than 2700 spot-formed spacing members, such as more than 3600 spot-formed spacing members.

As a further example, the separation disc may have a diameter that is more than 530 mm and comprise more than 1000 spot-formed spacing members, such as more than 2000 spot-formed spacing members, such as more than 3000 spot-formed spacing members, such as more than 4000 spot-formed spacing members.

Consequently, the present invention provides for large separation discs having a vast number of spot-formed spacing members which support a majority of the large compression forces that arise in a compressed stack of large separation discs. Thus, a greater number of small-sized spacing members may be arranged without reducing the effective separating area of the separation disc.

In embodiments of the first aspect of the invention, the separation disc is further comprising at least one through hole in the truncated conical surface or at least one cut-out at the outer periphery of the truncated conical surface so as to form axial rising channels in a stack of the separation discs.

The through hole may be round or in the form of an ellipse that is closed towards the outer radius of the separation disc. The cut-outs are slits in the periphery of the disc that are open towards the outer radius of the separation disc.

The separation disc may comprise more than four, such as more than five, such as more than six, through holes or slits. The separation disc may comprise either through holes or slits.

The axial rising channels are for feeding and distributing fluid mixture, such as a liquid, into the interspaces in a stack of separation discs.

As a second aspect of the invention, there is provided a stack of separation discs adapted to be comprised inside a centrifugal rotor for separating a liquid mixture, comprising axially aligned separation discs having a truncated conical shape with an inner surface and an outer surface, and wherein the axially aligned separation discs comprise a plurality of discs having spot-formed spacing members according to any embodiment of the first aspect of the invention discussed above.

The terms and definitions used in relation to the second aspect are the same as discussed in relation to the first aspect above.

The stack of separation discs may be aligned on an aligning member, such as on a distributor. Thus, in embodiments of the second aspect of the invention, the stack further comprises a distributor onto which the separation discs are aligned to form a stack.

The stack of separation discs may be adapted to be compressed with a force that is above 8 tons.

In embodiments of the second aspect of the invention, the plurality or number of separation discs having spot-formed spacing members may be more than 50% of the total number of separation discs in the stack of separation discs, such as more than 75% of the total number of separation discs in the stack of separation discs, such as more than 90% of the total number of separation discs in the stack of separation discs. As an example, all discs of the disc stack may be discs having spot-formed spacing members.

In embodiments of the second aspect of the invention, the plurality of discs having spot-formed spacing members are arranged so that a majority of the spot-formed spacing members of a disc are displaced compared to the spot-formed spacing members of an adjacent disc.

A spot-formed spacing member being "displaced" compared to a spot-formed spacing member on an adjacent disc refers to the discs being arranged so that the spot-formed spacing member is not at the same position as a spot-formed spacing member on an adjacent disc. Thus, a spot-formed spacing member being displaced does not abut an adjacent disc at a position where the adjacent disc has a spot-formed spacing member.

Hence, the discs having spot-formed spacing members may be arranged so that the spot-formed spacing members of a disc are not axially aligned with a spot-formed spacing member of an adjacent disc. Thus, the spot-formed spacing members may be radially displaced in relation to the spot-formed spacing members of adjacent discs as seen in an axial plane through the axis of rotation, and/or the spot-formed spacing members may be circumferentially displaced in relation to the spot-formed spacing members of adjacent discs as seen in a radial plane through the axis of rotation Displacement of spot-formed spacing members may be achieved by a disc being turned in the circumferential direction compared to an adjacent disc, such as turned through a predetermined angle in a circumferential direction. Thus, some or each separation disc may be gradually turned through an angle in the circumferential direction as the separation discs are being stacked on top of each other to form the stack.

As an example, a spot-formed and tip-shaped spacing member of one disc may be displaced in relation to a corresponding spot-formed and tip-shaped spacing member of an adjacent disc a circumferential distance and/or a radial distance that is between 2-15 mm, such as between 3-10 mm, such as about 5 mm.

As an example, a spot-formed and tip-shaped spacing member of one disc may be displaced in relation to a corresponding spot-formed and tip-shaped spacing member of an adjacent disc a circumferential distance that is about half of the mutual distance between spot-formed spacing members of the disc.

Furthermore, displacement of spot-formed spacing members may also be achieved by using separation discs having different patterns of spot-formed-spacing members so that the spot-formed spacing members of a disc are not axially aligned with the spot-formed spacing members of an adjacent disc when the discs are stacked on top of each other, such as stacked onto a distributor.

As an example, all spot-formed spacing members of a disc may be displaced compared to the spot-formed spacing members of an adjacent disc.

A stack in which the spot-formed spacing members are displaced, i.e. in which the spot-formed spacing members are not axially aligned on top of each other, is advantageous in that it may provide better support for thin discs, i.e. the thin discs in a stack have more points of support compared to if the discs are arranged so that the spot-formed spacing members are aligned on top of each other in the disc stack. Thus, a stack in which the spacing members are displaced facilitates the use of thin discs in the stack.

Furthermore, a stack in which the spot-formed spacing members are displaced may be advantageous in that it allows for easy manufacturing or assembly of the disc stack, i.e. the spot-formed spacing members allows even interspaces between discs in the stack even if the spot-formed spacing members are not axially aligned. In other words, in a disc stack, the spot-formed spacing members have the ability to bear the large compression forces in a compressed stack without having to be aligned on top of each other. This is thus different from the conventional idea of forming a disc stack, in which conventional elongated spacing members on the discs are axially aligned on top of each other in mutually adjacent separation discs throughout the stack of separation discs, or in other words, the spacing elements are in the prior art arranged in axially straight lines throughout the stack of separation discs, in order to bear all the compression forces in the compressed stack.

However, the discs in the stack may also be arranged so that the spot-formed spacing members are axially aligned. Thus, in embodiments of the second aspect of the invention, the discs having spot-formed spacing members are arranged so that a majority of the spot-formed spacing members of a disc are axially aligned with the spot-formed spacing members of an adjacent disc.

In embodiments of the second aspect of the invention, the stack comprises more than 100 separation discs, such as more than 150, such as more than 200, such as more than 250, such as more than 300 separation discs.

In embodiments of the second aspect of the invention, a majority of all discs in the stack are the discs having the spot-formed spacing members.

As an example, the stack may comprise more than 100 separation discs and more than 90% of those separation discs may be separation discs having spot-formed spacing members.

As an example, the stack may comprise more than 150 separation discs and more than 90% of those separation discs, such as all separation discs, may be separation discs having spot-formed spacing members.

As an example, the stack may comprise more than 200 separation discs and more than 90% of those separation discs, such as all separation discs, may be separation discs having spot-formed spacing members.

As an example, the stack may comprise more than 250 separation discs and more than 90% of those separation discs, such as all separation discs, may be separation discs having spot-formed spacing members.

As an example, the stack may comprise more than 300 separation discs and more than 90% of those separation discs, such as all separation discs, may be separation discs having spot-formed spacing members.

The separation discs having spot-formed spacing members in the disc stacks as exemplified above may have a diameter that is more than 300 mm and comprise more than 300 spot-formed spacing members, such as more than 1000 spot-formed spacing members, such as more than 1300 spot-formed spacing members, or they may have a diameter that is more than 350 mm and comprise more than 500 spot-formed spacing members, such as more than 1400 spot-formed spacing members, such as more than 1800 spot-formed spacing members, or they may have a diameter that is more than 400 mm and comprise more than 600 spot-formed spacing members, such as more than 1700 spot-formed spacing members, such as more than 2200 spot-formed spacing members, or they may have a diameter that is more than 450 mm and comprise more than 700 spot-formed spacing members, such as more than 1900 spot-formed spacing members, such as more than 2800 spot-formed spacing members, or they may have a diameter that is more than 500 mm and comprise more than 900 spot-formed spacing members, such as more than 2700 spot-formed spacing members, such as more than 3600 spot-formed spacing members, or they may have a diameter that is more than 530 mm and comprise more than 1000 spot-formed spacing members, such as more than 3000 spot-formed spacing members, such as more than 4000 spot-formed spacing members.

Consequently, the stack may comprise more than 300 separation discs having a diameter that is more than 500 mm and more than 90% of those separation discs, such as all separation discs, may be separation discs having spot-formed spacing members and comprise more than 3000 spot-formed spacing members, such as more than 4000 spot-formed spacing members.

Furthermore, the plurality of discs having spot-formed spacing members have a thickness that is less than 0.60 mm, such as less than 0.50 mm, such as less than 0.45 mm, such as less than 0.40 mm, such as less than 0.35 mm, such as less than 0.30 mm.

In embodiments of the second aspect of the invention, the stack of separation discs is arranged so that the spot-formed spacing members are the major load-bearing elements in the stack of separation discs.

This means that a majority of the compression forces are held by spot-formed spacing members in the disc stack.

In embodiments of the second aspect of the invention, the plurality of discs having spot-formed spacing members is free of discs having spacing members other than the spot-formed spacing members for creating interspaces between the discs in the stack.

Thus, the plurality of discs having spot-formed spacing members, and also the whole disc stack, may comprise solely spot-formed spacing members as load-bearing elements.

In embodiments of the second aspect of the invention, the stack of separation discs according further comprises at least one axial rising channel formed by at least one through hole in the truncated surface or formed by at least one cut-out at the outer periphery of separation discs in the stack.

As discussed in relation to the first aspect above, such axial rising channels may facilitate feeding and distributing fluid mixture, such as a liquid, into the interspaces in the stack of separation discs.

As a third aspect of the invention, there is provided a centrifugal separator for separation of at least two components of a fluid mixture which are of different densities, which centrifugal separator comprises a stationary frame, a spindle rotatably supported by the frame, a centrifuge rotor mounted to a first end of the spindle to rotate together with the spindle around an axis (X) of rotation, wherein the centrifuge rotor comprises a rotor casing enclosing a separation space in which a stack of separation discs is arranged to rotate coaxially with the centrifuge rotor, a separator inlet extending into the separation space for supply of the fluid mixture to be separated, a first separator outlet for discharging a first separated phase from the separation space, a second separator outlet for discharging a second separated phase from the separation space;

wherein the stack of separation discs is as according to any embodiment of the second aspect of the invention discussed above.

The terms and definitions used in relation to the third aspect are the same as discussed in relation to the other aspects above.

The centrifugal separator is for separation of a fluid mixture, such as a gas mixture or a liquid mixture. The stationary frame of the centrifugal separator is a non-rotating part, and the spindle and is supported by the frame by at least one bearing device, such as by at least one ball-bearing.

The centrifugal separator may further comprise a drive member arranged for rotating the spindle and the centrifuge rotor mounted on the spindle. Such a drive member for rotating the spindle and centrifuge rotor may comprise an electrical motor having a rotor and a stator. The rotor may be provided on or fixed to the spindle so that it transmits driving torque to the spindle and hence to the centrifuge rotor during operation.

Alternatively, the drive member may be provided beside the spindle and rotate the spindle and centrifuge rotor by a suitable transmission, such as a belt or a gear transmission.

The centrifuge rotor is adjoined to a first end of the spindle and is thus mounted to rotate with the spindle. During operation, the spindle thus forms a rotating shaft. The first end of the spindle may be an upper end of the spindle. The spindle is thus rotatable around the axis of rotation (X).

The spindle and centrifuge rotor may be arranged to rotate at a speed of above 3000 rpm, such as above 3600 rpm.

The centrifuge rotor further encloses a separation space in which the separation of the fluid mixture takes place. Thus, the centrifuge rotor forms a rotor casing for the separation space. The separation space comprises a stack of separation discs as discussed in relation to the second aspect of the invention above and the stack is arranged centrally around the axis of rotation. Such separation discs thus form surface enlarging inserts in the separation space.

The separator inlet for fluid mixture, i.e. feed, that is to be separated may be a stationary pipe arranged for supplying the feed to the separation space. The inlet may also be provided within a rotating shaft, such as within the spindle.

The first separator outlet for discharging a first separated phase from the separation space may be a first liquid outlet.

The second separator outlet for discharging a second separated phase from the separation space may be a second liquid outlet. Thus, the separator may comprise two liquid outlets, wherein the second liquid outlet is arranged at a larger radius from the rotational axis as compared to the first liquid outlet. Thus, liquids of different densities may be separated and be discharged via such first and second liquid outlets, respectively. The separated liquid of lowest density may be discharged via the first separator outlet whereas the separated liquid phase of higher density may be discharged via the second separator outlet, respectively.

During operation, a sludge phase, i.e. mixed solid and liquid particles forming a heavy phase, may be collected in an outer peripheral part of the separation space. Therefore, the second separator outlet for discharging a second separated phase from the separation space may comprise outlets for discharging such a sludge phase from the periphery of the separation space. The outlets may be in the form of a plurality of peripheral ports extending from the separation space through the centrifuge rotor to the rotor space between the centrifuge rotor and the stationary frame. The peripheral ports may be arranged to be opened intermittently, during a short period of time in the order of milliseconds, to enable discharge of a sludge phase from the separation space to the rotor space. The peripheral ports may also be in the form of nozzles that are constantly open during operation to allow a constant discharge of sludge.

However, the second separator outlet for discharging a second separated phase from the separation space may be a second liquid outlet, and the centrifugal separator may further comprise a third separator outlet for discharging a third separated phase from the separation space.

Such a third separator outlet comprise outlets for discharging a sludge phase from the periphery of the separation space, as discussed above, and may be in the form of a plurality of peripheral ports arranged to be opened intermittently or in the form of nozzles that are constantly open during operation to allow a constant discharge of sludge.

The centrifugal separator according to the third aspect of the invention is advantageous in that it allows for operation with high flow rates of feed, i.e. mixture to be separated.

In certain separator applications, the separation fluid during the separation process is kept under special hygienic conditions and/or without any air entrainment and high shear forces, such as when the separated product is sensitive to such influence. Examples of that kind are separation of dairy products, beer and in biotechnology applications. For such applications, so called hermetic separators have been developed, in which the separator bowl or centrifuge rotor is completely filled with liquid during operation. This means that no air or free liquid surfaces is meant to be present in the rotor during operation of the centrifugal separator.

In embodiments of the first aspect of the invention, at least one of the separator inlet, first separator outlet or second separator outlet is mechanically hermetically sealed.

Hermetic seals reduce the risk of oxygen or air getting into the separation space and contact the liquid to be separated.

Accordingly, in embodiments of the third aspect of the invention, the centrifugal separator is for separating dairy products, such as separating milk into cream and skimmed milk In embodiments of the third aspect of the invention, the stack of separation discs comprises at least 200, such as at least 300 separation discs having a diameter of at least 400 mm, and wherein the plurality of discs having spot-formed spacing members comprises at least 2000 spot-formed spacing members on each disc.

As an example, the stack of separation discs may comprise more than 300 separation discs and more than 90% of those separation discs, such as all separation discs, may have a diameter of at least 500 mm and may be separation discs having spot-formed spacing members comprising at least 4000 spot-formed spacing members on each disc.

As a fourth aspect of the invention, there is provided a method for separating at least two components of a fluid mixture which are of different densities comprising the steps of:

providing a centrifugal separator according to any embodiment of the third aspect above, supplying the fluid mixture which are of different densities via the separator inlet to the separation space;

discharging a first separated phase from the separation space via the first separator outlet; and discharging a second separated phase from the separation space via the second separator outlet.

The terms and definitions used in relation to the fourth aspect are the same as discussed in relation to the other aspects above.

As an example, the fluid mixture is milk, the first separated phase is a cream phase and the second separated phase is a skimmed milk phase.

In embodiments of the fourth aspect of the invention, the step of supplying comprises supplying at a flow rate which is above 60 $m^3$/hour, such as above 70 $m^3$/hour.

BRIEF DESCRIPTION OF THE DRAWINGS

FIG. 1*a* is a perspective view, FIG. 1*b* is a view from the bottom, i.e. showing the inner surface of the separation disc, and FIG. 1*c* is a close-up view of the outer periphery of the inner surface.

FIG. 4*a* is a perspective view, FIG. 4*b* is a radial section and FIG. 4*c* is a close up-view of the inner surface.

FIG. 5*a* is a radial section and FIG. 5*b* is a close up-view of the inner surface.

DETAILED DESCRIPTION

The separation disc, stack of separation discs and centrifugal separator according to the present disclosure will be further illustrated by the following description with reference to the accompanying drawings.

Figure 1A:
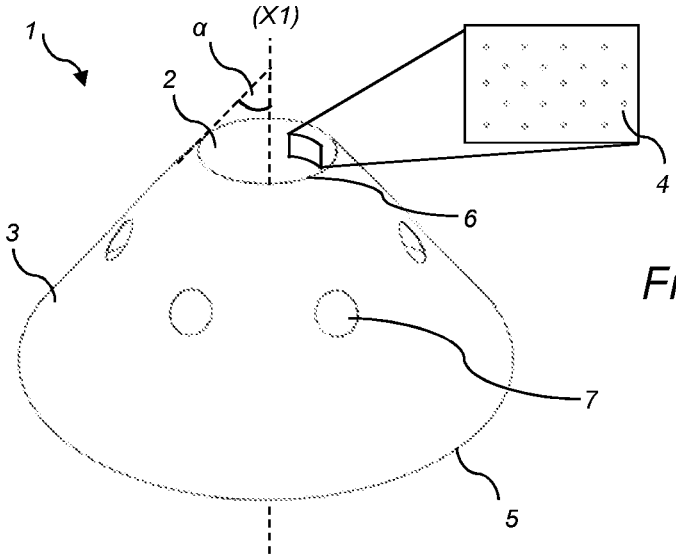
FIG. 1*a-c* shows an embodiment of a separation disc.
Figure 1B:
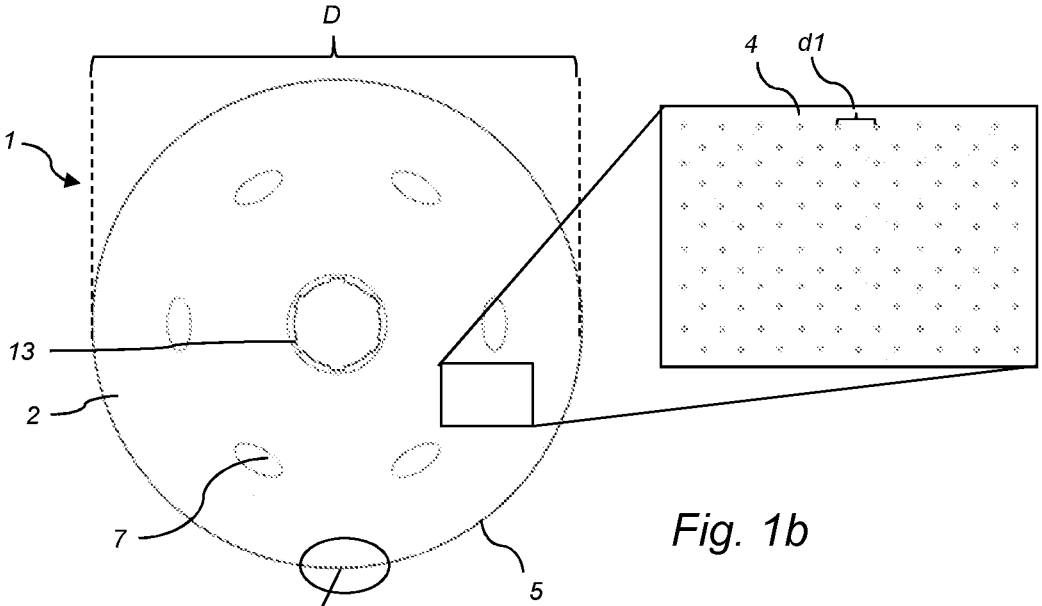
Figure 1C:
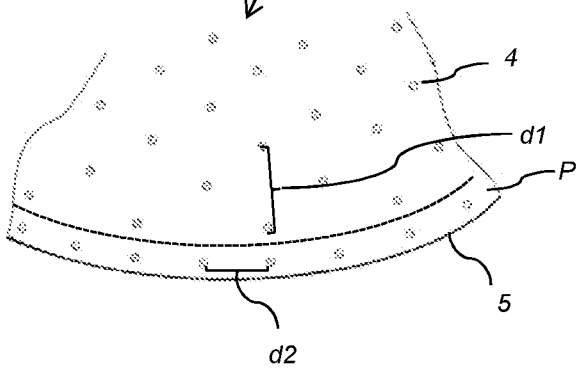

FIGS. 1*a-c* show schematic drawings of an embodiment of a separation disc. FIG. 1*a* is a perspective view of a separation disc 1 according to an embodiment of the present disclosure. The separation disc 1 has a truncated conical shape, i.e. a frusto-conical shape, along conical axis X1. Axis X1 is thus the direction of the axis passing through the apex of the corresponding conical shape. The conical surface forms cone angle $\alpha$ with conical axis X1. The separation disc has an inner surface 2 and an outer surface 3, extending radially from an inner periphery 6 to an outer periphery 5. In this embodiment, the separation disc is also provided with a number of through holes 7, located at a radial distance from both the inner and outer peripheries. When forming a stack with other separation discs of the same kind, through holes 7 may thus, form axial distribution channels for e.g. liquid mixture to be separated that facilitates even distribution of the liquid mixture throughout a stack of separation discs. The separation disc further comprises a plurality of spot-formed spacing members 4 extending above the inner surface of the separation disc 1. These spacing members 4 provide interspaces between mutually adjacent separation discs in a stack of separation discs. The spot-formed spacing members are tip-shaped and are shown in more detail in FIGS. 2*a-*2*f*. As seen in FIG. 1*a*, only the inner surface 2 is provided with spot-formed spacing members 4, whereas outer surface 3 is free of spot-formed spacing members 4 and also free of other spacing members. Inner surface 2 is also free of other spacing members than the spot-formed spacing members 4. Thus, in a stack of separation discs 1 of the same kind, spot-formed spacing members 4 are the only spacing members, i.e. the only members that form the interspaces and axial distances between discs in the stack. The spot-formed spacing members are thus the only load-bearing element on the disc 1 when discs are axially stacked on top of each other. This is thus a difference from a conventional separation disc, in which a few elongated, radially extending spacing members on each disc form the interspaces and bear the compression forces in a disc stack.

However, as an alternative, it is to be understood that outer surface 3 could be provided with the spot-formed spacing members 4 whereas inner surface 2 could be free of spot-formed spacing members 4 and also free of other spacing members.

FIG. 1*b* shows the inner surface 2 of the separation disc 1. The diameter D of the disc is in this embodiment about 530 mm, and the spot-formed spacing members 4 extends from a base at the inner surface 2 that has a width that is less than 1.5 mm along the inner surface 2 of the separation disc 1. Furthermore, the mutual distance d1 between the spot-formed spacing members 4 is about 10 mm, and the whole inner surface 2 comprises more than 4000 spot-formed spacing members 4.

There are also a number of cut-outs 13 at the inner periphery 6 of the separation disc 1 in order to facilitate stacking on e.g. a distributor.

FIG. 1*c* shows a close-up view of the outer periphery 5 of the inner surface 2 of the separation disc 1. In this embodiment, the density of spot-formed spacing members 4 is higher at the outer periphery than on the rest of the disc. This is achieved by having more spot-formed spacing members arranged in an outer peripheral zone P, so that the distance d2 between the radially outermost spacing members 4 within the outer peripheral zone P is less than the distance d1 between spacing members 4 outside this zone. Distance d2 may for example be around 5 mm, if d1 is about 10 mm. The peripheral zone P may for example extend 10 mm radially from the outer periphery 5. A higher density of spacing members at the outermost periphery is advantageous in that it decreases the risk for mutually adjacent discs in a disc stack touching each other at the outermost periphery where the compression and centrifugal forces are high. Mutually adjacent discs touching each other will block the interspace and thus lead to a decreased efficiency of the disc stack.

Figure 2A:
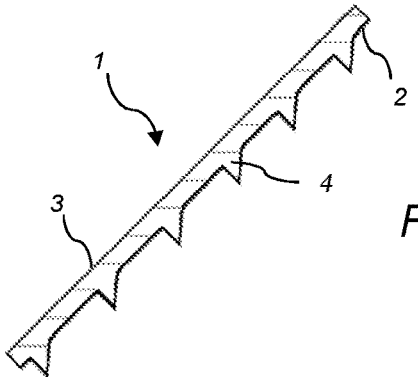
FIG. 2*a-f* shows embodiments of different tip-shaped and spot-formed spacing members.

FIGS. 2*a-*2*f* show embodiments of different tip-shaped and spot-formed spacing members. FIG. 2*a* shows a section of a part of a separation disc 1 in which the spot-formed spacing members 4 are arranged in a line extending in the radial direction on the inner surface 2 of the disc 1. Outer surface 3 is free of any kind of spacing member. The spacing members 4 are integrally formed in the separation disc 1, i.e.

formed in one piece with the material of the separation disc itself. The spacing members 4 are tip-shaped and taper from the surface to a tip that extends a certain distance or height from the inner surface 2.

Figure 2B:
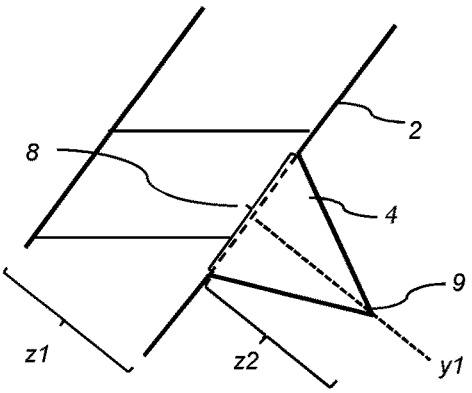

FIG. 2*b* shows a close-up view of an embodiment of a tip-shaped spacing member 4. The tip-shaped spacing member 4 extends from a base 8 on the inner surface 2. This base 8 extends to a width that is less than 1.5 mm along the inner surface 2 of the separation disc 1. The tip-shaped spacing member tapers from the base 8 to a tip 9 located a distance z2 from the base. Thus, the height of the tip-shaped spacing member is distance z2, which in this case is between 0.15 and 0.30 mm, whereas the thickness of the separation disc, as illustrated by distance z1 in FIG. 2*b*, is between 0.30 and 0.40 mm. In the example of FIG. 2*a*, the tip-shaped spacing member 4 extends from base 8 in the direction y1 that is substantially perpendicular to the inner surface 2. Direction y1 is thus parallel to the normal N of the inner surface 2.

Figure 2C:
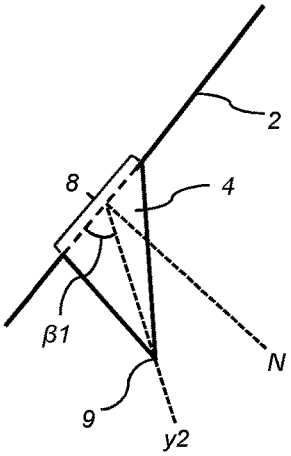

FIG. 2*c* shows an example of a tip-shaped spacing member 4 that extends from the surface of the separation disc in a direction that forms an angle with the surface which is less than 90 degrees. The spacing member 4 of FIG. 2*c* is the same as the spacing member shown in FIG. 2*b*, but with the difference that it extends in a direction y2 that forms an angle with the normal N of the inner surface. In this case, the tip-shaped spacing member 4 extends in a direction y2 that forms angle β1 with the inner surface 2, and angle β1 is less than 90 degrees. Thus, tip 9 extends from base 8 in direction γ2 that forms an angle with the surface that is about 60-70°.

Figure 2D:
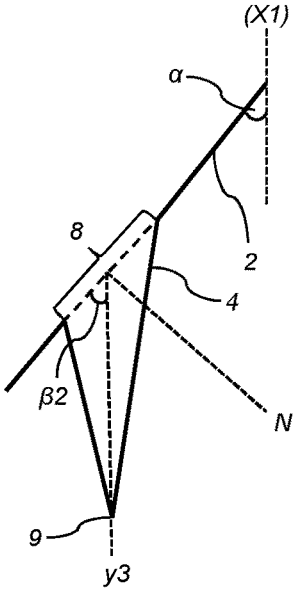

FIG. 2*d* shows a further example of a tip-shaped spacing member 4 that extends from the surface of the separation disc in a direction that forms an angle with the surface which is less than 90 degrees. The spacing member 4 of FIG. 2*d* is the same as the spacing member shown in FIG. 2*c*, but with the difference that it extends in a direction γ3 that forms an angle β2 with the inner surface 2 that is less that angle β1 in FIG. 2*c*. In this example, angle β2 is substantially the same as the alpha angle α of the separation disc 1, i.e. half of the opening angle of the corresponding conical shape of the separation disc. Angle α is thus the angle of the conical portion with conical axis X1 of the separation disc 1. Angle α may be about 35°. In other words, the tip-shaped spacing member 4 extend from the inner surface 2 of the separation disc 1 in substantially the axial direction of the truncated conical shape of the separation disc 1. Thus, in a formed stack of separation discs, a tip extending substantially axially may better adhere to an adjacent disc in the stack, thereby further decreasing the risk for unevenly sized interspaces between the discs as the stack is compressed.

It is to be understood that a majority or all spot-formed and tip-shaped spacing members 4 on a separation disc may extend in the same direction, i.e. a majority or all spot-formed and tip-shaped spacing members 4 on a separation disc may extend in a direction that is substantially perpendicular to the surface, like the example shown in FIG. 2*b*, or a majority or all spot-formed and tip-shaped spacing members 4 on a separation disc may extend in a direction that forms an angle with the surface, i.e. like the examples shown in FIGS. 2*c* and 2*d*. However, the spacing members on a surface may also extend in different directions.

Figure 2E:
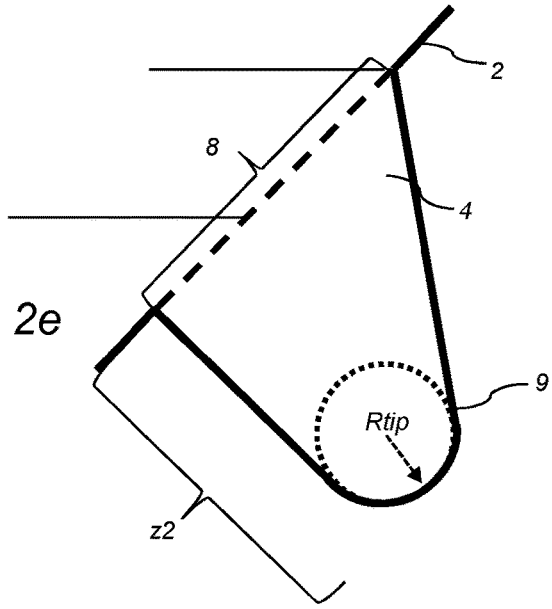

Furthermore, the tip 9 of a tip-shaped and spot-formed spacing member has a tip radius $R_{tip}$, and is further shown in more detail in FIG. 2*e*. This tip radius $R_{tip}$ is small in order to get as sharp tip as possible. As an example, tip radius $R_{tip}$ may be less than the height z2 to which the spot-formed spacing member 4 extend from the inner surface 2. Further, tip radius $R_{tip}$ may be less than half the height z2, such as less than a tenth of the height z2.

Figure 2F:
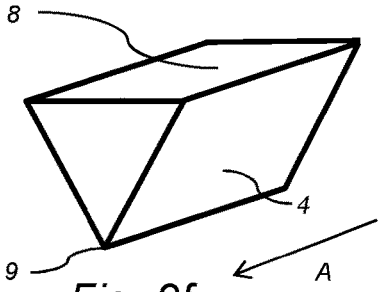

FIG. 2*f* shows an example of a spot-formed spacing member 4 that is tip-shaped in at least one cross-section and has a longitudinal extension in one direction. The spacing member 4 thus forms a ridge on the surface of the separation disc that extends in a direction indicated by arrow A along the surface. The direction A may be the radial direction of the separation disc. The direction A may be along the direction of the flow on the separation disc when used in a centrifugal separator. The tip 9 of the spot-formed spacing member 4 may have a longitudinal extension along the direction A of substantially the same length as the base 8 of the spot-formed spacing member 4 arranged on the surface (not shown) of the separation disc. Alternatively, the tip 9 of the spot-formed spacing member 4 may have a longitudinal extension along the direction A, which is shorter than the length of the base 8 of the spot-formed spacing member 4 arranged on the surface (not shown) of the separation disc.

The dimensions as discussed above related to the width of the base 8 of the spot-formed spacing member 4, also apply to the width of the spot-formed spacing member 4 along the direction A in the embodiments of FIG. 2*f*. The width along direction A may be the same as, or differ from the distance across direction A. Thus, according to embodiments the width of the base 8 may be less than 5 mm along the surface of the separation disc. As an example, the base 8 of the spot-formed spacing member may extend to a width 8 which is less than 2 mm along the surface of the separation disc, such as to a width which is less than 1.5 mm along the surface of the separation disc, such as to a width which is about or less than 1 mm along the surface of the disc.

Figure 3:
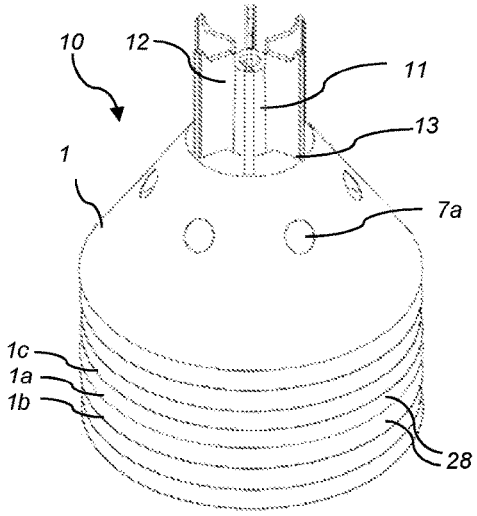
FIG. 3 shows an embodiment of a disc stack.

FIG. 3 shows an embodiment of a disc stack 10 according to the present disclosure. The disc stack 10 comprises separation discs 1 provided on a distributor 11. For clarity, FIG. 3 only shows a few separation discs 1, but it is to be understood that the disc stack 10 may comprise more than 100 separation discs 1, such as more than 300 separation discs. Due to the tip-shaped and spot-formed spacing members, interspaces 28 are formed between stacked separation discs 1, i.e. interspaces 28 is formed between a separation disc 1*a* and the adjacent separation discs 1*b* and 1*c* located below and above separation disc 1*a*, respectively. Through holes in the separation discs form axial rising channels 7*a* extending throughout the stack. Furthermore, the disc stack 10 may comprise a top disc (not shown), i.e. a disc arranged at the very top of the stack that is not provided with any through holes. Such a top disc is known in the art. The top disc may have a diameter that is larger than the other separation discs 1 in the disc stack in order to aid in guiding a separated phase out of a centrifugal separator. A top disc may further have a larger thickness as compared to the rest of the separation discs 1 of the disc stack 10. The separation discs 1 may be provided on the distributor 11 using cut outs 13 at the inner periphery 6 of the separation discs 10 that are fitted in corresponding wings 12 of the distributor.

Figure 4A:
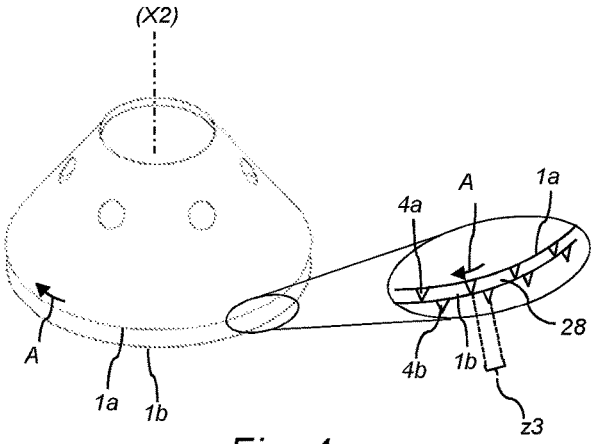
FIG. 4*a-c* shows an embodiment of a disc stack in which the spot-formed spacing members of a separation disc are displaced in relation to the spot-formed spacing members of an adjacent disc.
Figure 4B:
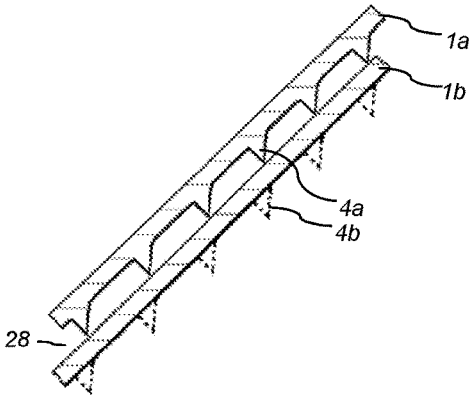
Figure 4C:
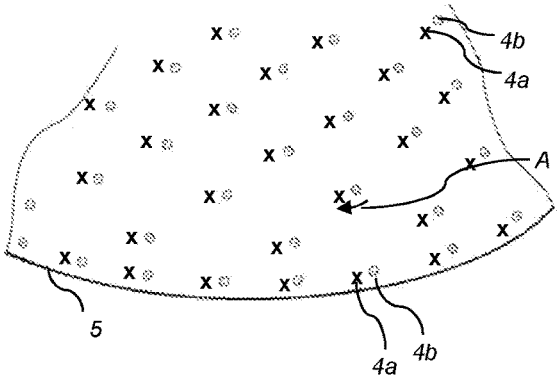

FIGS. 4*a-c* show an embodiment in which the separation discs 1 are axially arranged in the stack 10 so that a majority of the spot-formed and tip-shaped spacing members 4*a* of a disc 1*a* are displaced compared to the spot-formed and tip-shaped spacing members 4*b* of an adjacent disc 1*b*. In this embodiment, this is performed by a small rotation in the circumferential direction of disc 1*a* as compared to adjacent disc 1*b*, as illustrated by arrow "A" in FIGS. 4*a* and 4*c*. Thus, as seen in FIG. 4*a*, adjacent separation discs 1*a* and 1*b* are axially aligned along rotational axis X2, which is the same direction as conical axis X1 as seen in FIGS. 1 and 2, but due to the arrangement of the spot-formed and tip-shaped spacing members, a spot-formed and tip-shaped spacing member 4*a* of separation disc 1*a* is not axially aligned over corresponding spot-formed and tip-shaped spacing member 4*b* of separation disc 1*b*. As an example, the discs 1*a* and 1*b* are arranged so that a spot-formed and tip-shaped spacing member 4*a* of disc 1*a* is displaced a circumferential distance z3 in relation to corresponding spot-formed and tip-shaped spacing member 4*b* of disc 1*b*. Distance z3 may be about half the distance of the mutual distance between spot-formed and tip-shaped spacing members on a disc, such as between 2-10 mm.

In other words, the separation discs of the disc stack 1 are arranged so that a spot-formed and tip-shaped spacing member 4*a* of a separation disc 1*a* does not abut adjacent disc 1*b* at a position where the adjacent disc 1*b* has spot-formed and tip-shaped spacing member 4*b*. This is also illustrated in FIG. 4*b*, which shows a section of adjacent discs 1*a* and 1*b*. The spot-formed and tip-shaped spacing members 4*a* of disc 1*a* and the spot-formed and tip-shaped spacing members 4*b* of disc 1*b* may be provided at the same radial distance, but are shifted in the circumferential direction. Furthermore, FIG. 4*c* shows a close-up view of the outer periphery 5 of disc 1*b*. The spot-formed and tip-shaped spacing members 4*a* of adjacent disc 1*a* abut separation disc 1*b* at positions indicated by crosses in FIG. 4*c*, which are positions that are shifted in the circumferential direction as compared to the positions of the spot-formed and tip-shaped spacing members 4*b*, as illustrated by arrow "A".

Figure 5A:
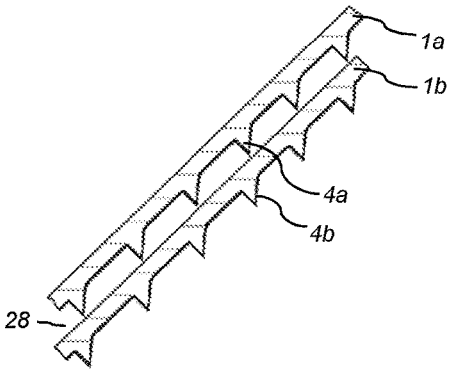
FIGS. 5*a* and *b* shows an embodiment of a disc stack in which the spot-formed spacing members of a separation disc are axially aligned with the spot-formed spacing members of an adjacent disc.
Figure 5B:
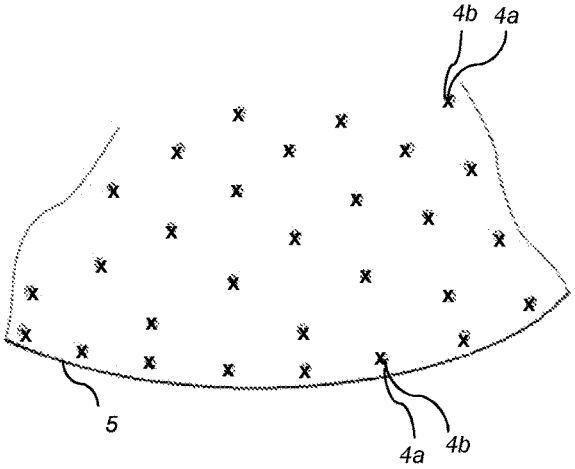

However, the separation discs 1 of the disc stack 10 may be provided on the distributor 11 so that a majority of the spot-formed and tip-shaped spacing members of a disc are axially aligned with the spot-formed and tip-shaped spacing members of an adjacent disc, as in a conventional disc stack having elongated radial spacing members. This is illustrated in FIGS. 5*a* and 5*b*, in which adjacent separation discs 1*a* and 1*b* are provided so that the spot-formed and tip-shaped spacing members 4*a* of disc 1*a* are aligned with the spot-formed and tip-shaped spacing members 4*b* of disc 1*b*. FIG. 5*a*, shows a section of adjacent discs 1*a* and 1*b* in which spacing members 4*a* and 4*b* are aligned, whereas FIG. 5*b* shows a close-up view of the outer periphery 5 of disc 1*b*. In contrast to the embodiment illustrated in FIG. 4*c*, the spot-formed and tip-shaped spacing members 4*a* of adjacent disc 1*a* actually abut separation disc 1*b* at the positions of the spot-formed and tip-shaped spacing members 4*b* of discs 1*b*, as indicated by the crosses in FIG. 5*b*.

Figure 6:
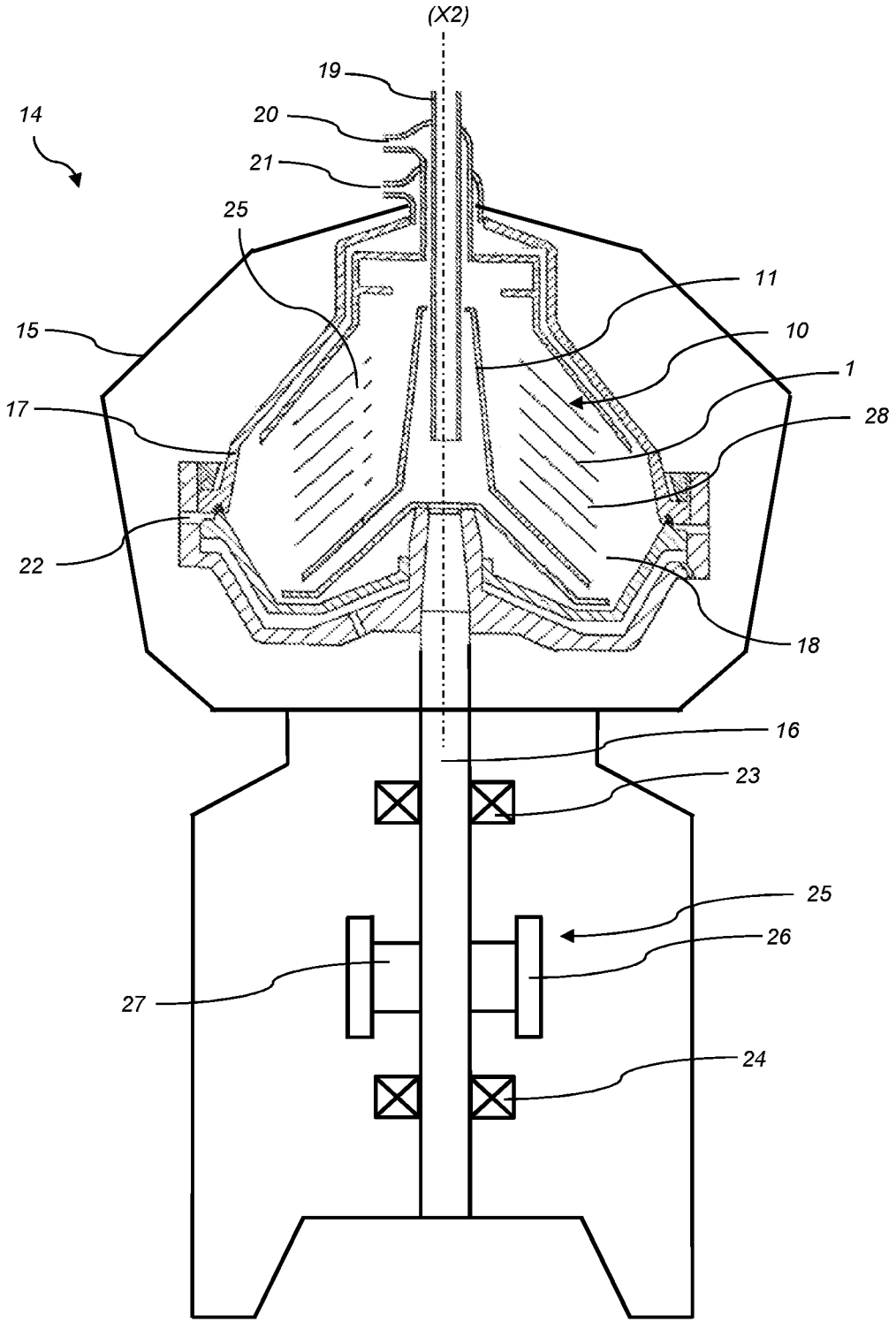
FIG. 6 shows a cross-section through a centrifugal separator.

FIG. 6 shows a schematic example of a centrifugal separator 14 according to an embodiment of the present disclosure, arranged to separate a liquid mixture into at least 2 phases.

The centrifugal separator 14 comprises a rotating part arranged for rotation about an axis of rotation (X2) and comprises rotor 17 and spindle 16. The spindle 16 is supported in a stationary frame 15 of the centrifugal separator 14 in a bottom bearing 24 and a top bearing 23. The stationary frame 15 surrounds rotor 17.

The rotor 17 forms within itself a separation chamber 18 in which centrifugal separation of e.g. a liquid mixture takes place during operation. The separation chamber 18 may also be referred to as a separation space 18.

The separation chamber 18 is provided with a stack 10 of frusto-conical separation discs 1 in order to achieve effective separation of the fluid to be separated. The stack 10 of truncated conical separation discs 1 are examples of surface-enlarging inserts. These discs 1 are fitted centrally and coaxially with the rotor 17 and also comprise through holes which form axial channels 25 for axial flow of liquid when the separation discs 9 are fitted in the centrifugal separator 1. The separation discs 1 and stack 10 are as discussed in relation to any embodiment shown in FIGS. 1-4 above. In FIG. 6, only a few discs 1 are illustrated in the stack 10, and the stack may comprise more than 100 separation discs 1, such as more than 200 separation discs, such as more than 300 separation discs.

The centrifugal separator 14 is in this case fed from the top via stationary inlet pipe 19, which thus forms an inlet channel for introducing e.g. a liquid mixture for centrifugal separation to the separation space 18 of the centrifugal separator. The inlet channel may also be referred to as a separator inlet. Liquid material to be separated may be transported to a central duct in the distributor 11, e.g. by means of a pump (not shown). Such a pump may be arranged to supply liquid material to be separated with a flow rate of above 60 $m^3$/hour, such as above 70 $m^3$/hour to the inlet pipe 19 of the centrifugal separator 14.

The rotor 17 has extending from it a liquid light phase outlet 20 for a lower density component separated from the liquid, and a liquid heavy phase outlet 21 for a higher density component, or heavy phase, separated from the liquid. The outlets 20 and 21 extend through the frame 15. The outlets 20, 21 may also be referred to as separator outlets 20, 21. Further, centripetal pumps, such as paring discs, may be arranged at outlets 20 and 21 to aid in transporting separated phases out from the separator.

However, the centrifugal separator 14 may also be of a so-called hermetic type with a closed separation space 18, i.e. the separation space 18 may be intended to be completely filled with liquid during operation. In principle, this means that preferably no air or free liquid surfaces is meant to be present within the rotor 17. This means that also the inlet 19 and the outlets 20 and 21 may be mechanically hermetically sealed to reduce the risk of oxygen or air getting into the separation space and contact the liquid to be separated.

The rotor 17 is further provided at its outer periphery with a set of radially sludge outlets 22 in the form of intermittently openable outlets for discharge of higher density component such as sludge or other solids in the liquid. This material is thus discharged from a radially outer portion of the separation chamber 18 to the space around the rotor 17.

The centrifugal separator 14 is further provided with a drive motor 25. This motor 25 may for example comprise a stationary element 26 and a rotatable element 27, which rotatable element 27 surrounds and is so connected to the spindle 16 that during operation it transmits driving torque to the spindle 16 and hence to the rotor 17. The drive motor 25 may thus be an electric motor. Furthermore, the drive motor 25 may be connected to the spindle 16 by transmission means. The transmission means may be in the form of a worm gear which comprises a pinion and an element connected to the spindle 16 in order to receive driving torque. The transmission means may alternatively take the form of a propeller shaft, drive belts or the like, and the drive motor may alternatively be connected directly to the spindle.

During operation of the separator in FIG. 6, the rotor 17 is caused to rotate by torque transmitted from the drive motor 25 to the spindle 16. Via the stationary inlet pipe 19, liquid mixture to be separated is brought into the separation space 18. The liquid mixture to be separated, i.e. the feed, may be introduced when the rotor is already running at its operational speed. Liquid material may thus be continuously introduced into the rotor 17.

Depending on the density, different phases in the liquid is separated in the interspaces 28 between the separation discs 1 of the stack 10 fitted in the separation space 18. Heavier components in the liquid move radially outwards between the separation discs, whereas the phase of lowest density moves radially inwards between the separation discs and is forced through outlet 20 arranged at the radial innermost level in the separator. The liquid of higher density is instead forced out through outlet 21 that is at a radial distance that is larger than the radial level of outlet 20. Thus, during separation, an interphase between the liquid of lower density and the liquid of higher density is formed in the separation space 18. Solids, or sludge, accumulate at the periphery of the separation chamber 18 and is emptied intermittently from the separation space by the sludge outlets 22 being opened, whereupon sludge and a certain amount of fluid is discharged from the separation space by means of centrifugal force. However, the discharge of sludge may alternatively take place continuously, in which case the sludge outlets 22 take the form of open nozzles and a certain flow of sludge and/or heavy phase is discharged continuously by means of centrifugal force.

In certain applications, the separator 14 only contains a single liquid outlet, such as only liquid outlet 20, and the sludge outlets 22. This depends on the liquid material that is to be processed.

In the embodiment of FIG. 6, the liquid mixture to be separated is introduced from above via a stationary pipe 19. However, the liquid mixture to be separated may as an alternative be introduced from below via a central duct arranged in spindle 16. However, such a hollow spindle may also be used for withdrawing e.g. the liquid light phase and/or the liquid heavy phase. As an example, the spindle 16 may be hollow and comprise a central duct and at least one additional duct. In this way, the liquid mixture to be separated may be introduced to the rotor 17 via a central duct arranged in the spindle 16, and concurrently the liquid light phase and/or the liquid heavy phase may be withdrawn through the additional duct in the spindle 16.

The centrifugal separator 14 may be arranged to separate milk into cream and skimmed milk.

Figure 7:
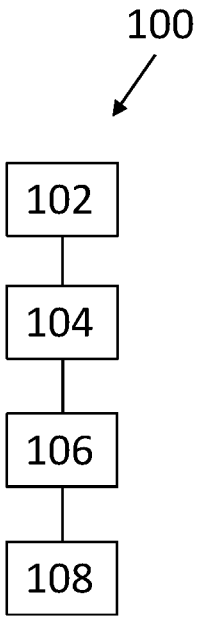
FIG. 7 illustrates a method for separating at least two components of a fluid mixture.

FIG. 7 illustrates a method 100 for separating at least two components of a fluid mixture which are of different densities comprising the steps of:

providing 102 a centrifugal separator 14 according to any of aspects and/or embodiments discussed herein, supplying 104 the fluid mixture which are of different densities via the separator inlet 19 to the separation space 18;

discharging 106 a first separated phase from the separation space 18 via the first separator outlet 20; and discharging 108 a second separated phase from the separation space via the second separator outlet 21.

The invention is not limited to the embodiment disclosed but may be varied and modified within the scope of the claims set out below. The invention is not limited to the type of separator as shown in the Figures. The term "centrifugal separator" also comprises centrifugal separators with a substantially horizontally oriented axis of rotation and separator having a single liquid outlet.

The invention claimed is:

1. A separation disc for a centrifugal separator, said disc being adapted to be included in a stack of separation discs inside a centrifugal rotor for separating a fluid mixture, wherein the separation disc comprises:

a body having a truncated conical shape with an inner surface and an outer surface, a circumferential direction and a longitudinal direction; and a plurality of spot-formed spacing members extending a height from at least one of the inner surface and the outer surface, the plurality of spot-formed spacing members spaced from each other in the circumferential direction and the longitudinal direction, wherein said plurality of spot-formed spacing members are for providing interspaces between mutually adjacent separation discs in a stack of separation discs, wherein said plurality of spot-formed spacing members have a generally triangular cross-section that tapers from a base at said at least one of the inner surface and the outer surface of the separation disc towards an apex at said height from said at least one of the inner surface and the outer surface, wherein the base of the spot-formed spacing members extend to a width which is less than 5 mm along the surface of the separation disc, and wherein the width is a largest dimension of the spot-formed spacing members.

2. The separation disc according to claim 1, wherein at least one of said inner surface and said outer surface is free of spacing members other than said spot-formed spacing members.

3. The separation disc according to claim 1, wherein the plurality of spot-formed spacing members is integrally formed in one piece with the material of the separation disc.

4. The separation disc according to claim 1, wherein the separation disc has a thickness that is less than 0.5 mm.

5. The separation disc according to claim 1, wherein the separation disc comprises more than 300 of said plurality of spot-formed spacing members.

6. The separation disc according to claim 1, wherein the inner or outer surface has a surface density of said plurality of spot-formed spacing members that is above 25 spacing members/dm2.

7. A stack of separation discs adapted to be comprised inside a centrifugal rotor for separating a liquid mixture, comprising axially aligned separation discs having a truncated conical shape with an inner surface and an outer surface, and wherein said axially aligned separation discs comprise a plurality of discs having spot-formed spacing members according to claim 1.

8. The stack of separation discs according to claim 7, wherein said discs having spot-formed spacing members are arranged so that a majority of said spot-formed spacing members of one of said discs are axially aligned with the spot-formed spacing members of an adjacent disc.

9. A centrifugal separator for separation of at least two components of a fluid mixture which are of different densities, which centrifugal separator comprises:

a stationary frame;

a spindle rotatably supported by the frame;

a centrifuge rotor mounted to a first end of the spindle to rotate together with the spindle around an axis of rotation, wherein the centrifuge rotor comprises a rotor casing enclosing a separation space in which a stack of separation discs is arranged to rotate coaxially with the centrifuge rotor;

a separator inlet extending into said separation space for supply of the fluid mixture to be separated;

a first separator outlet for discharging a first separated phase from said separation space; and a second separator outlet for discharging a second separated phase from said separation space, wherein the stack of separation discs is as according to claim 7.

10. A method for separating at least two components of a fluid mixture which are of different densities comprising the steps of:

providing the centrifugal separator according to claim 9;

supplying said fluid mixture which are of different densities via said separator inlet to said separation space;

discharging a first separated phase from said separation space via said first separator outlet; and discharging a second separated phase from said separation space via said second separator outlet.

11. The separation disc according to claim 1, wherein a line between an apex of the spacing member and a center of the base is in substantially the axial direction of the truncated conical shape of said separation disc.

12. The separation disc according to claim 1, wherein the generally triangular cross-section is formed by a first side wall extending from the body to a point and a second sidewall extending from the body to the point.

13. A separation disc for a centrifugal separator, said disc being adapted to be included in a stack of separation discs inside a centrifugal rotor for separating a fluid mixture, wherein the separation disc comprises:

a body having a truncated conical shape with an inner surface and an outer surface, a circumferential direction and a longitudinal direction; and a plurality of spot-formed spacing members extending a height from at least one of the inner surface and the outer surface, the plurality of spot-formed spacing members spaced from each other in the circumferential direction and the longitudinal direction, wherein said plurality of spot-formed spacing members are for providing interspaces between mutually adjacent separation discs in a stack of separation discs, wherein said plurality of spot-formed spacing members have a generally triangular cross-section that tapers from a base at said at least one of the inner surface and the outer surface of the separation disc towards an apex at said height from said at least one of the inner surface and the outer surface, wherein the base of the spot-formed spacing members extend to a width which is less than 5 mm along the surface of the separation disc, and wherein a base of each of the plurality of spacing members is a circle, an ellipse or a square.

14. A separation disc for a centrifugal separator, said disc being adapted to be included in a stack of separation discs inside a centrifugal rotor for separating a fluid mixture, wherein the separation disc comprises:

a body having a truncated conical shape with an inner surface and an outer surface, a circumferential direction and a longitudinal direction; and a plurality of spot-formed spacing members extending a height from at least one of the inner surface and the outer surface, the plurality of spot-formed spacing members spaced from each other in the circumferential direction and the longitudinal direction, wherein said plurality of spot-formed spacing members are for providing interspaces between mutually adjacent separation discs in a stack of separation discs, wherein said plurality of spot-formed spacing members have a generally triangular cross-section that tapers from a base at said at least one of the inner surface and the outer surface of the separation disc towards an apex at said height from said at least one of the inner surface and the outer surface, wherein the base of the spot-formed spacing members extend to a width which is less than 5 mm along the surface of the separation disc, and wherein the tip of said plurality of spot-formed spacing members has a tip radius in a cross-section which is less than the height to which said spot-formed spacing members extend from the surface.

15. A stack of separation discs adapted to be comprised inside a centrifugal rotor for separating a liquid mixture, comprising axially aligned separation discs having a truncated conical shape with an inner surface and an outer surface, and wherein said axially aligned separation discs comprise a plurality of discs having spot-formed spacing members, wherein each of the plurality of disc comprises:

a body having a truncated conical shape with an inner surface and an outer surface, a circumferential direction and a longitudinal direction; and a plurality of spot-formed spacing members extending a height from at least one of the inner surface and the outer surface, the plurality of spot-formed spacing members spaced from each other in the circumferential direction and the longitudinal direction, wherein said plurality of spot-formed spacing members are for providing interspaces between mutually adjacent separation discs in a stack of separation discs, wherein said plurality of spot-formed spacing members have a generally triangular cross-section that tapers from a base at said at least one of the inner surface and the outer surface of the separation disc towards an apex at said height from said at least one of the inner surface and the outer surface, wherein the base of the spot-formed spacing members extend to a width which is less than 5 mm along the surface of the separation disc, and wherein said plurality of discs having spot-formed spacing members are arranged so that a majority of said spot-formed spacing members of one of said discs are displaced compared to the spot-formed spacing members of an adjacent disc.

* * * * *